US005112257A

United States Patent [19]

Grise

[11] Patent Number: 5,112,257

[45] Date of Patent: May 12, 1992

[54] MULTI-USE VEHICLE

[76] Inventor: Frederick J. Grise, R.R. #1, Aston Resort, Bracebridge, Ontario, Canada, P0B 1C0

[21] Appl. No.: 583,092

[22] Filed: Sep. 17, 1990

[51] Int. Cl.[5] ..... B63H 7/02

[52] U.S. Cl. ..... 440/37; 114/43

[58] Field of Search ..... 114/345, 43, 360; 440/37

[56] References Cited

U.S. PATENT DOCUMENTS 1,816,118 7/1931 Knight ..... 114/43
3,261,038 7/1966 Klepper ..... 114/345
3,500,784 3/1970 Reynolds ..... 114/43

FOREIGN PATENT DOCUMENTS 2618123 1/1989 France ..... 440/37

*Primary Examiner*—Sherman Basinger

[57] ABSTRACT

A multi-purpose vehicle, for use on water and on ice, and having a hull with a generally flat floor, and flotation chambers around the floor, a low friction panel of protective material attachable to the underside of the hull, a frame adapted to be attached to the hull located above the rearward end of the hull and defining an open space forwardly of the frame, a motor supported by the frame and an air propulsion device connected to the motor to create forward thrust, a seat in the open space, and, a guide device mounted on the frame and being moveable from side to side to guide movement of the vehicle.

9 Claims, 3 Drawing Sheets

MULTI-USE VEHICLE

FIELD OF THE INVENTION

The invention relates to a multi-use vehicle, and in particular to a vehicle adapted for travelling over water, ice, and, to some extent, snow.

BACKGROUND OF THE INVENTION

The provision of a multi-use vehicle adapted for travel both over ice and water presents a combination of problems. Two principal problems are the support of the vehicle, on both media, and the propulsion of the vehicle on both media. In a typical situation, such a vehicle may be travelling over ice, around the shoreline of a body of water, and at some point there will be a transition to water, and then the vehicle may again be travelling over ice. The vehicle must be capable of making such a transition smoothly, and without any warning, since it is often difficult to determine exactly where the transition will take place. Thus, both the support of the vehicle and its propulsion means must be fully suitable to travelling on both media one after the other, and to making the transition from one media to the other at any moment.

Clearly, since the vehicle is to be travelling at least in part over water, then there must be some means of buoyancy provided, in the form of some form of hull. However, typical marine hulls do not lend themselves in any way to travel on ice. In the selection of a means of propulsion, it is apparent that the typical marine propeller type of propulsion means used in water will be inoperative on ice. On the other hand, traction belt propulsion devices such as are used in snow vehicles, which are suitable for travel over snow and ice, are unsuitable for propulsion in water. In the past, proposals have been made for multi-media vehicle known as "all terrain vehicles" (ATV) which were provided with a water proof body, and a set of four or six oversized, low pressure tires. These vehicles did have a relatively limited capability of travel on ice, although with very little real control, and also a limited degree of capability for travel in water, at low speeds. However, generally speaking, they were not suitable for travel in snow and, in fact, ATVs find their greatest application on land "off road". Ground effect vehicles are known, in which a large fan is provided, driving air downwardly so that the vehicle in fact rests on a cushion of air. These vehicles will perform on almost any surface, and would certainly perform on intermittent patches of water and ice, and on snow. However, they are relatively expensive to manufacture and are inefficient to operate.

One of the uses for which the present invention is particularly suited is the rescue of persons who become marooned on moving ice floes. This situation occurs every year, when ice fishermen remain on the ice too late in the season. Attempts to rescue them using a conventional boat can be frustrating, at the least, and also dangerous. These situations may occur on lakes in widely scattered areas, and it is desirable that a rescue craft shall be available which can be placed on a trailer, and rapidly transported to the scene, and this is simply impractical with ground effect air-cushion vehicles.

It will, of course, be appreciated however that the invention may have numerous other applications besides simply the rescuing of persons on ice floes, and the invention is not to be considered as in any way restricted to this situation.

Marine craft are known for travelling in shallow water, or in swampy areas, which consist typically of pontoons, and a propulsion unit consisting of an engine driving an aircraft propeller. These craft are excellent for the purpose for which they are intended. However, they would not be in any way suitable for making a transition from water to ice and back again.

These pontoon swamp craft are typically used at a permanent location, by commercial operators, providing transportation to the public on a fare-paying basis, for example, in wildlife swamps in sub-tropical locations.

Typically these craft will be built to order, and in fact have not enjoyed wide distribution. From an economic viewpoint, it is clearly desirable to provide a multi-media craft which is both useful, and also provides an enjoyable sport for persons interested in outdoor activities in the winter. The success of the track-driven snow vehicle industry is clear evidence that there is a major market in this area. However, in order to reap the potential of the market for a multi-media vehicle capable of travelling on water and ice, as well as snow, it is necessary to have a vehicle which can be manufactured on a mass production basis, and which ideally is capable of being shipped in a knocked-down condition as a kit, and which can then simply be assembled by the consumer, or the distributor, as the case may be.

BRIEF SUMMARY OF THE INVENTION

With a view to satisfying the foregoing objectives, the invention comprises a multi-use vehicle, for use on water, and ice, and comprising a hull having at least a generally flat floor portion, and peripheral flotation chamber means, extending at least around the forward end and sides of said floor portion, low friction panel means of protective material attachable to the underside of said floor portion to provide a smooth running surface for said vehicle, and adapted to extend at least partially around the exterior of said chamber means, and having means for attaching same to said hull, frame means adapted to be attached to said hull, located above the rearward end of said hull, and defining an open space forwardly of said frame means, within said hull, motor means supported by said frame means, air propulsion means connected to said motor means and adapted to be rotated thereby, whereby to create forward thrust, means for transferring said forward thrust to said hull, seat means in said open space, and guide means mounted on said frame means and being movable from side to side, whereby to guide movement of said vehicle.

The invention further comprises such a multi-use vehicle and wherein said frame means comprises a generally upright rectangular frame structure, mounted adjacent the rear of said hull, and, generally pyramid-like frame rod means being supported within said pyramid rod means.

The invention further comprises such a multi-use vehicle and including drive shaft means extending rearwardly from said motor means, propeller shaft support means located in said generally rectangular upright frame means, and adapted to be rotated parallel to, but spaced from, said drive shaft means, and drive transmission means extending therebetween.

The invention further comprises such a multi-use vehicle and including thrust transmission rod means extending from said generally pyramid-shaped rod means forwardly and downwardly, and connecting rod means extending therefrom to the forward end of said hull, and including thrust means located at said forward end of said hull for transmitting thrust thereto.

The invention further comprises such a multi-use vehicle and wherein said frame means further includes side rod means adapted to be positioned along either of said peripheral flotation chamber means, and supporting said generally rectangular frame means and said pyramid rod means in position.

The invention further comprises such a multi-use vehicle and including guard rod frame means extending from said generally rectangular frame means on either side thereof rearwardly thereof and substantially enclosing said air propulsion means on either side.

The invention further comprises such a multi-use vehicle and including control means for controlling said guide means, whereby to guide said multi-use vehicle, and throttle means operable to control the speed of said motor means, said control means being located adjacent said seat means.

The invention further comprise such a multi-use vehicle and including floor rod means extending from front to back of said floor portion of said hull, and connected at their forward end to said thrust means and including transverse rod means at their rearward end connecting same to said side rod means.

The various features of novelty which characterize the invention are pointed out with more particularity in the claims annexed to and forming a part of the disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
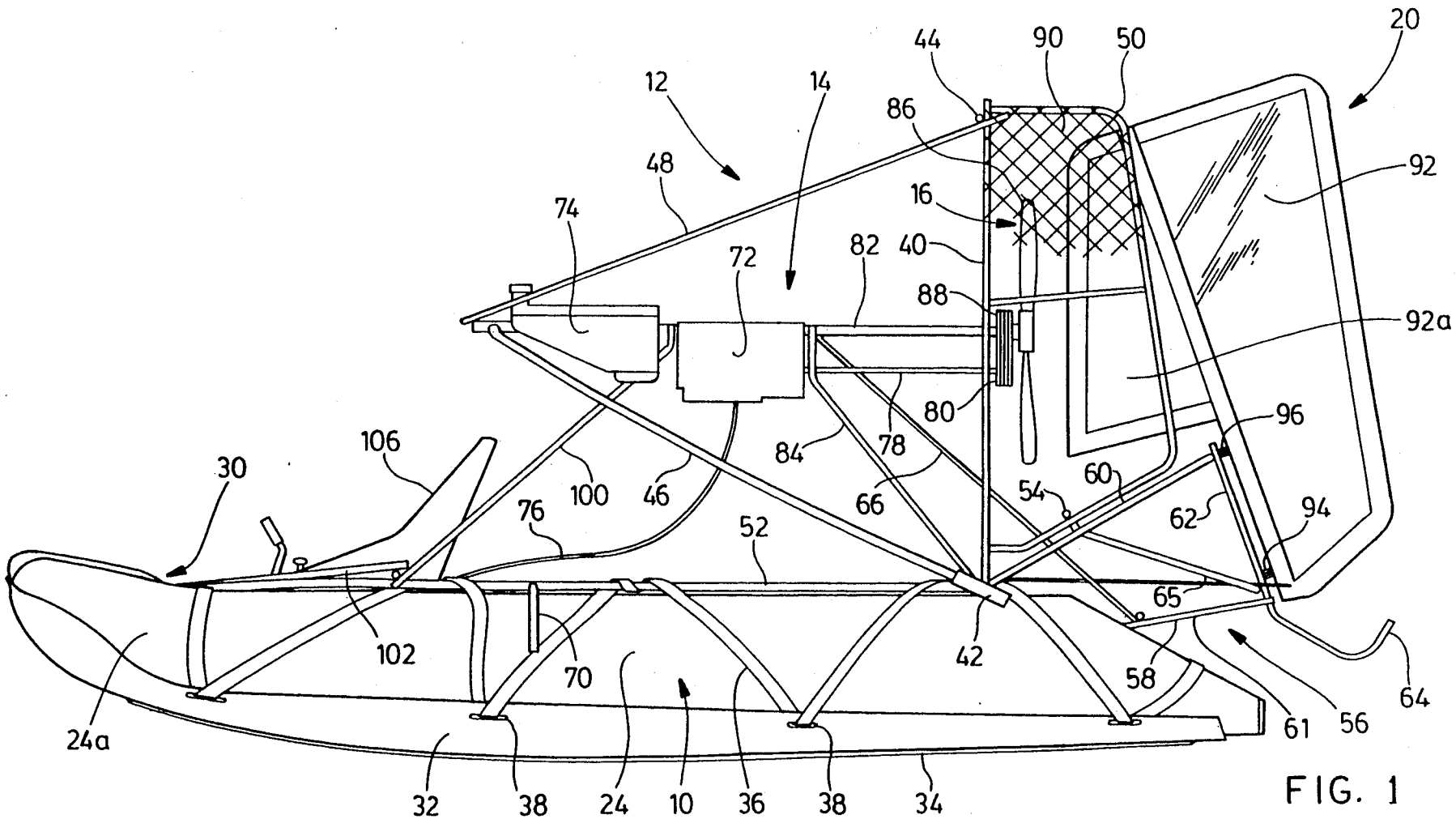
FIG. 1 is a side elevation of a multi-use vehicle in accordance with the invention.
Figure 2:
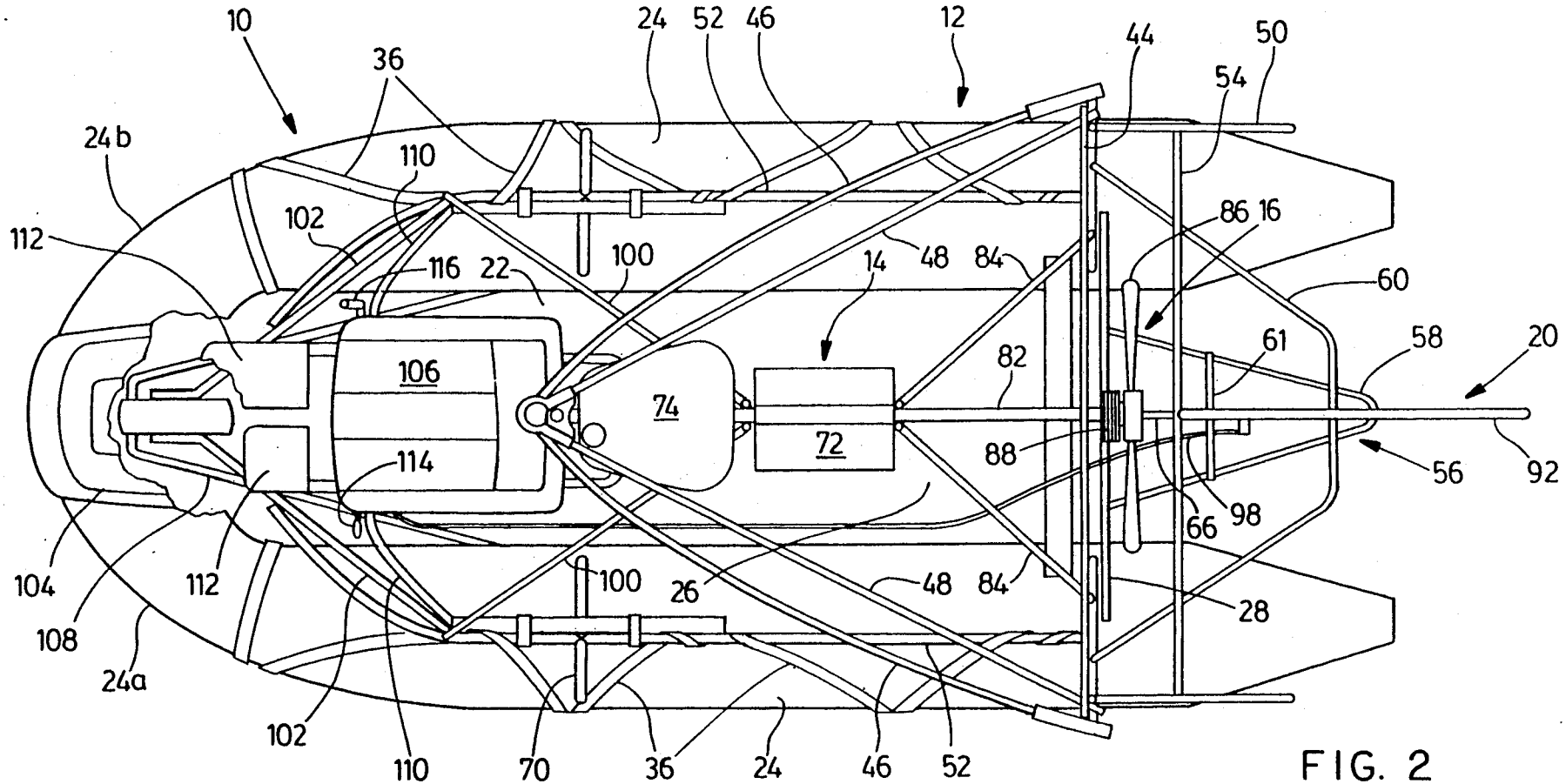
FIG. 2 is a top plan of the vehicle of FIG. 1.
Figure 3:
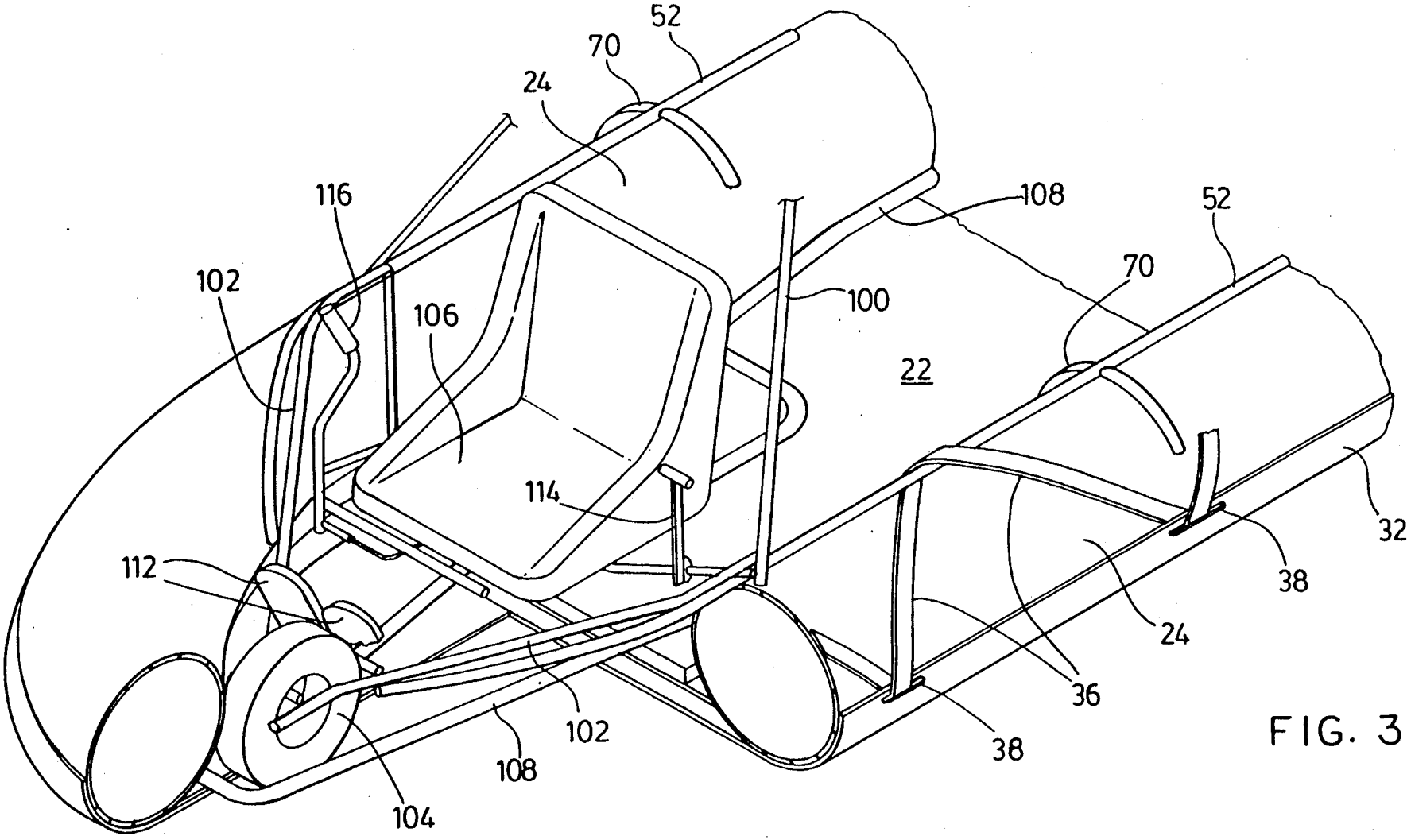
FIG. 3 is a front perspective of the vehicle of FIG. 1, partly cut away.

Referring first of all to FIG. 1, it will be seen that the invention comprises a marine craft indicated generally as 10, typically of the inflatable type, to which an open work frame indicated generally as 12 is attached. The frame 12 supports a motor and propeller indicated generally as 14 and 16, and an air reaction guidance means, namely a tail plane 20. It will thus be seen as the description proceeds, that the invention provides a multi-use vehicle capable of travelling on either ice or water, its nature, and its propulsion means, being capable of operating on both media. In addition, as will be seen from the following description, the vehicle is also capable of operating in certain circumstances on snow, although its principal application is on combinations of water and ice.

THE WATER CRAFT

The water craft 10 will be seen to be of essentially conventional construction such as is available from a number of manufacturers. Thus it has a flexible more or less flat floor 22 and around the two sides of the floor, two flotation chambers 24—24 are provided. At the front of the floor 22, the two chambers curve as at **24*a*—24*a*, and meet at a point, providing a form of bow. In the particular design of the craft illustrated, the rear of the floor as at 26 may be, in some cases, provided with a transverse flotation chamber, and is provided with a more or less rigid transom 28**, of the type to which a conventional marine power unit such as an outboard motor (not shown) might be attached, if the craft were to be used solely on water.

As will become apparent as the description proceeds, the two bow portions **24*a*—24*a* of the flotation chambers meet, and form a pocket or recess 30, over the floor 22**, in the region of the bow.

Typically, such water craft are made of flexible water-proof fabric, usually treated with rubber or plastic so as to be collapsible when not in use and capable of being inflated for use on water. However, the invention is not restricted solely to such craft of this type.

Of particular importance to the object of the invention is the fact that an abrasion-resistant low friction panel means 32, is attached to the craft around the exterior or under surface of the floor and extending up partially around the flotation chambers 24—24 and **24*a*—24*a*. The panel means 32** is formed typically of thermoplastic material such as polyethylene, or the like, of a sufficient thickness to resist wear and tear and scuffing in use, and yet still retain an adequate degree of flexibility. It is such that it may be discarded and replaced if damaged.

The panel means 32 is provided with one or more guide means or runners 34 running lengthwise along the underside, whereby to assist maintaining the directional stability of the vehicle in use on ice in particular.

The panel means 32 is secured in a manner to be described below by means of straps 36, engaging the panel means by any suitable means such as strap openings 38 formed around the periphery thereof.

THE FRAME

The frame 12 will be seen to comprise an essentially open structure formed of various rod portions.

The frame consists of, in this example, two upright rods 40, arranged spaced apart, and joined at their lower ends by a substantially horizontal rod 42, and joined at their upper ends by a substantially horizontal rod 44, so as to define a space essentially in the form of a rectangle.

Two lower pyramid rods 46—46 are secured at the junction of rods 40 and 42, and two upper pyramid rods 48—48 are secured at the junction of rods 40 and 44. Rods 46 and 48 extend forwardly generally in the shape of a pyramid. Rods 48 are straight and rods 46 are curved for reasons described below. Guard rods 50—50 of generally D-shaped configuration are secured at the junctions of rods 40 and 42, and 40 and 44, and extend rearwardly.

A pair of generally horizontal side rods 52—52 are secured at the junctions of rods 40 and 42, and extend forwardly, lying on chambers 24—24.

A lower transverse bracing rod 54 extends between lower portions of guard rods 50—50.

In order to support the steering mechanism, a lower sub-frame indicated generally as 56 is provided. The frame 56 comprises a lower rod 58 bent into a generally triangular shape, and an upper rod 60, bent so as to form a truncated triangle. A lower bracing rod 61 is secured to lower rod 58 transversely thereof. A central angled junction rod 62 extends between rods 58 and 60, and a lower skeg 64 is formed by a bent portion of the lower end of rod 62. A central bracing rod 65 extends from rod 62 to rod 54.

A diagonal bracing rod 66 extends from lower bracing rod 61 and is secured at its upper end to shaft 82 (see below). The triangular bent rod 58 is secured to the transom of the inflatable craft.

The frame is attached in position, with the horizontal side rods 52—52 resting on the flotation chambers. The frame is located so that it extends rearwardly thereof.

The frame is secured in position, by means of the straps 36, extending upwardly from the panel 32, and wrapped around side rods 52. As a result, it will be seen that while the frame is securely held in position, it is not in fact attached directly to the fabric of the craft itself, other than its attachment to the transom 28. In order to assist in locating the side frame rods in position, transverse locating rods 70—70 may be provided, curved to follow the curvature of the flotation chambers 23.

In this way, it is possible to use an inflatable craft as it is supplied by the manufacturer, without the requirement for any special modification other than securing the rod 58 to the transom.

Supported within the frame is a prime mover, in this case, an internal combustion engine 72. The engine will be supplied with a suitable fuel tank 74 and carburetor and the like, in a manner well known in the art and not specifically illustrated. A throttle control cable 76 extends from the engine, for reasons to be described below.

The engine drive shaft 78 is provided with a suitable drive member, e.g., a drive pulley, sprocket, or gear 80 or the like. Spaced from the drive shaft, is a propeller shaft 82. Propeller shaft 82 extends from the junction of the four shafts and 48—48 rearwardly, to a point of diagonal bracing rods 84—84 extend from the junction between the lower ends of rods 40, and the lower transverse rod 42 forwardly and upwardly to shaft 82.

The propeller 86 is rotatably mounted on a suitable bearing (not shown) at the rearward end of shaft 82. A suitable driven member, on the propeller is coupled by any suitable means to the pulley 80 or the like on the engine drive shaft.

The propeller is thus located above and at the rear of the craft, and is substantially enclosed within the guard rod portions of the frame. For safety reasons, netting 90 is stretched around the frame in the region of the propeller.

In order to control the direction of movement of the craft, an air reaction guidance device, namely a tail plane or rudder 92 is pivotally mounted on the rearward portion of the frame as at pivots 94-96.

In this way, the tail plane can be swung to and fro about an upright forwardly slanting axis.

A forward portion **92*a*** of the tail plane swings outwardly to and fro opposite to the main area thereof, to balance the forces.

A control cable 98 is provided, for reasons to be described below, so that the tail plane can be swung to and fro in the manner of a rudder on an aircraft.

In order to transmit the forward thrust of the propeller, to the craft, and to avoid forward rotation of the frame: two spaced-apart thrust reaction rods 100—100 are provided extending from shaft 82, forwardly towards either side of the craft, above the two flotation chambers, and are secured to side rods 52.

Two diagonal rods 102—102 are provided, connected to rods 52, and rods 100, and extending forwardly therefrom diagonally and converging at the bow of the craft. At the bow they are secured to a thrust member 104 which is, in this case, a small diameter wheel with an inflated tire thereon. This, in turn, is located in the pocket or recess 30 between the floor, and the flotation chambers **24*a*—24*b*** at the bow.

A seat 106 is provided, forwardly of the frame, and secured between the side rods 52, for carrying a driver.

In order to mount and secure the seat 106, a floor frame is provided comprising floor frame rods 108—108 located at their forward ends and adjacent to the thrust member 104 and extending rearwardly thereof. Adjacent their rearward ends they are secured to a transverse support rod 110, connected to side rods 52.

In order to assist the driver in sitting in the vehicle, a foot rest, in this case, a pair of swingable foot pedals 112, may be provided, against which the feet may be braced. The usual seat belt (not shown) may also be provided if desired.

A manual hand throttle 114 is provided on one side of the seat 106, and rudder control 116 is provided on the other side, swingable from side to side transversely of the longitudinal axis of the craft.

In operation, the driver will sit in the seat 106, and by the operation of the throttle 114 may set the motor 72 to the appropriate speed to drive propeller 86 and cause forward propulsion at the speed desired. By the operation of the rudder control 116 by manually swinging it from one side to the other, the tail plane 92 can be swung to one side or the other, thereby guiding the movement of the multi-use vehicle.

The runners 34 will provide a degree of stability as the vehicle moves over ice surfaces. When the vehicle slides from ice to water, the flotation chambers 24 and **24*a* and 24*b* will support it in the water, and it will move smoothly across the water. When it encounters an ice floe, it will simply mount the edge of the ice floe and proceed over the ice. Any abrasion or damage which might be caused to the bottom of the hull by passage over the edge of the ice, for example, or passage over broken ice, will be withstood by means of the panel 32**.

In the event that the vehicle is used to rescue persons stranded on an ice floe in an open body of water, then all the operator has to do is to simply drive the vehicle across the water, crossing any intervening ice floes, until he comes to the stranded person or persons on a particular floe. He then simply, as it were, "parks" the vehicle on that ice floe. The persons can then climb into the rear of the vehicle, behind the seat 106, in the open space located below pyramid frame rods 46 and motor 72. These persons can then neither sit on the floor of the hull or lie down, in whatever manner they can, and the operator can then simply drive the vehicle across both ice and water back to safety on land.

It will thus be seen that the vehicle provides a highly efficient and effective form of transportation operable both over water and ice surfaces, without any alteration in the propulsion or guidance or support systems of the vehicle.

In the event that the ice floes are covered with snow, or in the event that there is considerable snow on the edge of the lake or body of water, then the operator simply drives the vehicle up over the snow. The low-friction surface of the panel 32 will permit the vehicle to glide over the snow, at least until any substantial upgrade is encountered.

The vehicle besides its utility for rescue, has numerous applications for recreational use which will be self-evident.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A multi-use vehicle, for use on water, and on ice, and comprising:

a flotation hull having at least a generally flat floor portion, and peripheral flotation chamber means, extending at least around the forward end and sides of said floor portion;

cover panel means of protective material attachable over the underside of said floor portion to provide a smooth running surface for said vehicle, and adapted to extend at least partially around the exterior of said flotation chamber means, and having means for attaching same on said hull;

frame means adapted to be attached to said hull, located above the rearward end of said hull, and defining an open space forwardly of said frame means, within said hull;

wherein said frame means comprises a generally upright rectangular frame structure, mounted adjacent the rear of said hull, and generally pyramid-like frame rod means extending forwardly therefrom;

motor means supported by said frame means within said pyramid-like frame rod means;

air propulsion means connected to said motor means and adapted to be driven thereby, whereby to create forward thrust;

means for transferring said forward thrust to said hull;

seat means, in said open space forwardly of said frame means, and, guide means mounted on said frame means and being moveable from side to side, whereby to guide movement of said vehicle.

2. A multi-use vehicle as claimed in claim 1 and including drive shaft means extending rearwardly from said motor means, propeller means located in aid generally rectangular upright frame structure, and adapted to be rotated parallel to, but spaced from, said drive shaft means, and drive transmission means extending therebetween.

3. A multi-use vehicle as claimed in claim 1 and including thrust transmission rod means extending from said generally pyramid-like frame rod means forwardly and downwardly, and connecting rod means extending therefrom to the forward end of said hull, and including thrust means located at said forward end of said hull for transmitting thrust thereto.

4. A multi-use vehicle as claimed in claim 1 and wherein said frame means further includes side rod means adapted to be positioned along either of said peripheral chamber means, and supporting said generally upright rectangular frame structure and said pyramid-like frame rod means in position.

5. A multi-use vehicle as claimed in claim 1 and including guard rod frame means extending from said generally upright rectangular frame structure on either side thereof rearwardly thereof and substantially enclosing said air propulsion means on either side.

6. A multi-use vehicle as claimed in claim 1 and including guide control means for controlling said guide means, whereby to guide said multi-use vehicle, and throttle control means operable to control the speed of said motor means, said control means being located adjacent said seat means.

7. A multi-use vehicle, for use on water, and on ice, and comprising:

a flotation hull having at least a generally flat floor portion, and peripheral flotation chamber means, extending at least around the forward end and sides of said floor portion;

cover panel means of protective material attachable over the underside of said floor portion to provide a smooth running surface for said vehicle, and adapted to extend at least partially around the exterior of said flotation chamber means, and having means for attaching same on said hull;

frame means adapted to be attached to said hull, located above the rearward end of said hull, and defining an open space forwardly of said frame means, within said hull;

motor means supported by said frame means;

air propulsion means connected to said motor means and adapted to be driven thereby, whereby to create forward thrust;

means for transferring said forward thrust to said hull;

seat means, in said open space forwardly of said frame means;

guide means mounted on said frame means and being moveable from side to side, whereby to guide movement of said vehicle; and, floor rod means extending from the forward end towards the back of said floor portion of said hull, and connected at their forward end to said thrust means, and including transverse rod means at their rearward ends connecting same to said frame means.

8. A multi-use vehicle, for use on water, and on ice, and comprising;

a flotation hull having at least a generally flat floor portion, and peripheral flotation chamber means, extending at least around the forward end and sides of said floor portion;

cover panel means of protective material attachable over the underside of said floor portion to provide a smooth running surface for said vehicle, and adapted to extend at least partially around the exterior of said flotation chamber means, and having means for attaching same on said hull;

frame means adapted to be attached to said hull, located above the rearward end of said hull, and defining an open space forwardly of said frame means, within said hull;

motor means supported by said frame;

air propulsion means connected to said motor means and adapted to be driven thereby, whereby to create forward thrust;

means for transferring said forward thrust to said hull;

seat means, in said open space forwardly of said frame means, guide means mounted on said frame means and being moveable from side to side, whereby to guide movement of said vehicle, and, locating rod means shaped to lie transversely over respective said peripheral flotation chamber means, said locating rod means being secured to said frame means.

9. A multi-use vehicle as claimed in claim 8 including, guide rib means formed on the exterior undersurface of said cover panel means and extending longitudinally thereof.

* * * * *